US005494255A

United States Patent [19]

Pearson et al.

[11] Patent Number: 5,494,255

[45] Date of Patent: Feb. 27, 1996

[54] SOLENOID ACTIVATED EXHAUST GAS RECIRCULATION VALVE

[75] Inventors: Earl Pearson, Knoxville; Alfred A. Frankenberg, Seymour, both of Tenn.

[73] Assignee: Robertshaw Controls Company, Richmond, Va.

[21] Appl. No.: 340,759

[22] Filed: Nov. 16, 1994

Related U.S. Application Data

[63] Continuation-in-part of Ser. No. 180,661, Jan. 12, 1994, Pat. No. 5,460,146.

[51] Int. Cl.[6] ..... F02M 25/07; H01F 7/08; F16K 37/00

[52] U.S. Cl. ..... 251/129.15; 335/278; 123/571

[58] Field of Search ..... 123/339, 571; 251/129.15, 129.16, 129.17; 335/219, 220, 221, 236, 255, 261, 278, 279

[56] References Cited

U.S. PATENT DOCUMENTS

| | | | |
|---|---|---|---|
| 4,024,484 | 5/1977 | Tomczak et al. | 336/30 |
| 4,442,998 | 4/1984 | Ohyama et al. | 335/255 |
| 4,567,910 | 2/1986 | Slavin et al. | 137/82 |
| 4,583,067 | 4/1986 | Hara | 335/261 |
| 4,662,604 | 5/1987 | Cook | 251/129.07 |
| 4,720,078 | 1/1988 | Nakamura et al. | 251/129.15 |
| 4,809,742 | 3/1989 | Grau | 251/129.15 |
| 4,882,558 | 11/1989 | Takayanagi | 335/278 |
| 4,919,390 | 4/1990 | Ichiryu et al. | 251/129.15 |
| 4,998,707 | 3/1991 | Meyer et al. | 251/129.15 |
| 5,020,505 | 6/1991 | Grey et al. | 123/571 |
| 5,094,218 | 3/1992 | Everingham et al. | 123/571 |
| 5,188,073 | 2/1993 | Ejiri et al. | 251/129.15 |
| 5,232,196 | 8/1993 | Hutchings et al. | 251/129.15 |

OTHER PUBLICATIONS

PCT International Search Report for International Application No. PCT/US95/00573, May 26, 1995.

Ford Motor Company Purchase Order 47–E–E82778 to Robertshaw Controls Co., dated Oct. 29, 1990.

Robertshaw Controls Co. Sales Invoice 18795–01 to Ford Motor Company, date Nov. 7, 1990.

Ford Motor Company Request for Quotation 47–E–E85531 to Robertshaw Controls Co., dated Dec. 17, 1990.

Robertshaw Controls Co. Sales Invoice 19092–01 to Ford Motor Company, dated Jan. 7, 1991.

Robertshaw Tennessee Division Solenoid EGR Valve Exp. Dwg. No. 27235–RC, dated Jul. 12, 1990.

*Primary Examiner*—Willis R. Wolfe

*Attorney, Agent, or Firm*—Watts, Hoffmann, Fisher & Heinke Co.

[57] ABSTRACT

A valve for combining exhaust gas from an engine combustion chamber with engine intake gases. The valve includes a valve body having a gas inlet and a gas outlet connected by a throughpassage. A flow control member supported by the valve body regulates flow through the valve body throughpassage. A magnetic drive is supported for movement with respect to the valve body and coupled to the flow control member to regulate flow in the throughpassage. An electronically actuated field-generating solenoid moves the magnetic drive member to control flow through the valve body. The solenoid and a sensor for monitoring a position of the magnetic drive are supported within a plastic molded housing. The plastic housing also partially encapsulates a pole piece that forms a magnetic circuit in combination with the magnetic drive.

32 Claims, 8 Drawing Sheets

SOLENOID ACTIVATED EXHAUST GAS RECIRCULATION VALVE

CROSS REFERENCE TO RELATED APPLICATION

The present application is a continuation-in-part application having common subject matter with U.S. patent application Ser. No. 08/180,661 entitled "Solenoid Activated Exhaust Gas Recirculation Valve" in the name of Frankenburg which was filed in the United States Patent and Trademark Office on Jan. 12, 1994, now U.S. Pat. No. 5,460,146.

FIELD OF THE INVENTION

The present invention concerns an exhaust gas recirculation valve (EGR valve) for combining exhaust gas from an engine combustion chamber with intake gases before routing a combination of exhaust gas and intake gases to the engine combustion chamber.

BACKGROUND ART

Recirculating exhaust gases back to the intake manifold of an internal combustion engine lowers combustion temperature and reduces the emission of nitrous oxides into the atmosphere. Exhaust gas recirculation (EGR) valves have been used to regulate the proportion of combustion by-products routed back to the intake manifold.

In the prior art, the amount of gas recirculation was controlled in part by means of a vacuum signal that regulated the opening and closing of the EGR valve. Vacuum ports in a throttle valve housing were used to obtain a pressure indication to control opening and closing of the EGR valve. As the engine throttle is first opened, the vacuum ports couple vacuum to the EGR valve, opening the EGR valve and routing combustibles back to the intake manifold. As the throttle valve opens wider, the vacuum supplied to the EGR valve diminishes and the EGR valve closes. When the engine temperature is below a set point temperature, the EGR valve was closed to prevent rough idling of the engine. Adjusting EGR valve setting based on temperature requires a temperature sensor and a means to control the EGR setting based on the sensed temperature.

U.S. Pat. No. 4,662,604 to Cook discloses an EGR valve for an internal combustion engine. A valve housing supports a valve stem that moves back and forth to open and close the EGR valve in response to energization of a solenoid. The present invention concerns an improved electronically actuated EGR valve wherein exhaust gas flow through the valve is adjusted based upon sensed conditions and a control signal is generated based upon those sensed conditions to adjust the valve setting. The valve includes a solenoid assembly that converts the control signal into a linear movement of a flow-regulating member within the valve.

DISCLOSURE OF THE INVENTION

An exhaust gas re-circulation valve assembly constructed in accordance with a preferred embodiment of the present invention combines exhaust gas from an engine combustion chamber with engine intake gases.

In accordance with one embodiment of the invention a valve assembly includes a valve body having an inlet, an outlet, and defining a valve body passageway interconnecting the inlet with the outlet. A valve stem is supported for movement relative to the valve body and includes a flow regulating stem portion positioned within the valve body passage for regulating gas flow through the valve body. A valve actuator is coupled to the valve stem for positioning the valve stem relative the valve body and thus control the position of a flow regulating stem portion within the valve body.

A valve actuator housing is attached to the valve body and encloses the valve actuator. The valve actuator housing includes a cavity defining methyl housing member having an opening for inserting the valve actuator into the valve housing during assembly of the valve apparatus. A plastic molded housing encloses the valve actuator inside the cavity defined by the metal housing member.

The valve actuator includes a magnetic member coupled to the valve stem for moving the valve stem back and forth along a travel path. A conductive coil encapsulated within the plastic molded housing sets up a magnetic field to position the magnetic member. Electrical contacts for energizing the conductive coil are partially encapsulated within the plastic molded housing.

On embodiment of the valve apparatus includes a position sensor for monitoring a position of the magnetic member and for providing a feedback signal corresponding to the sensed position of the magnetic member. The plastic molded housing comprises first and second plastic molded pieces that enclose said position sensor. In this embodiment of the invention electrical contacts partially encapsulated within the plastic molded housing energize the sensor. One electrical contact routes the feedback signal corresponding to the sensed postion of the magnetic member from the plastic housing to a connector outside the housing.

Alternate embodiments of the present invention are described below. Various objects, advantages and features of the invention will become apparent from a review of this description when reviewed in conjunction with the accompanying drawings.

DETAILED DESCRIPTION OF THE DRAWINGS

Figure 1:
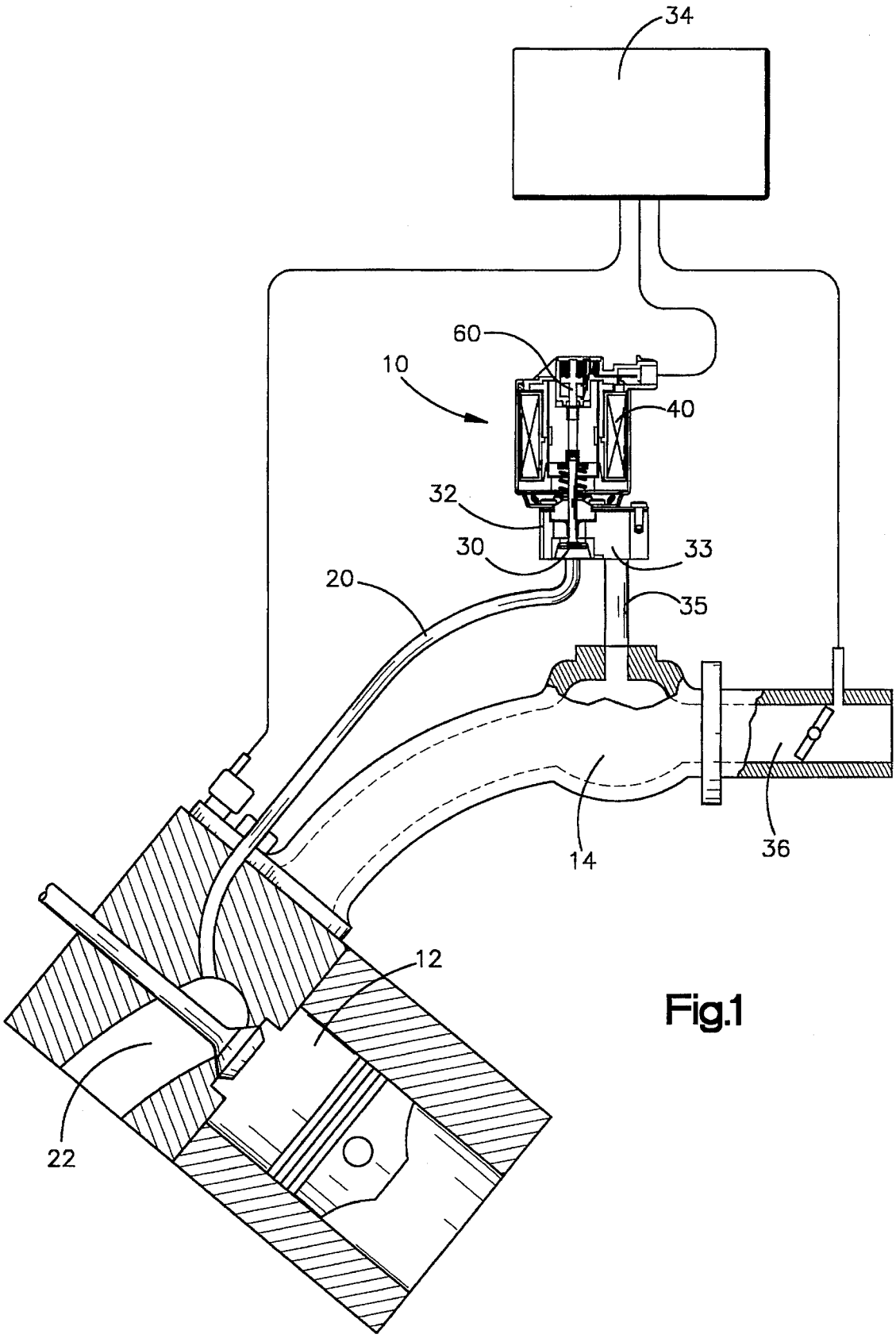
FIG. 1 is a schematic showing a combustion chamber and a fluid conduction path for routing combustibles from the exhaust chamber to the EGR valve of FIG. 1.

The drawings illustrate a valve assembly 10 for routing exhaust gases containing combustion by-products from an engine combustion chamber 12 to a region 14 upstream of the combustion chamber 12 where the exhaust gases are combined with combustibles before they enter the combustion chamber 12. A recirculation pipe 20 routes gas from an exhaust manifold 22 to the valve assembly 10. A valve flow control member 30 moves back and forth with respect to a valve body 32 (FIG. 3) to regulate the volume of exhaust gas that flows through a valve body passageway 33 to a pipe 35 which routes the exhaust gases back to the combustion chamber via a passageway leading to the combustion chamber 12.

Flow through the valve assembly 10 is electronically controlled by a computer or programmable controller 34 that monitors engine conditions such as temperature of the combustion chamber, engine speed and load, and pressure of gases entering an intake manifold 36. In response to these sensed conditions, the computer 34 determines a desired volume of exhaust gas recirculation and an appropriate valve setting to achieve the desired volume of flow. A pulse width modulated output signal generated by the computer 34 activates an EGR valve solenoid 40 to adjust the position of the flow control member 30 and provide the desired volume of exhaust gas flow through the passageway 33.

The pulse width modulated signal from the computer 34 energizes a solenoid coil 42 (FIG. 3) which sets up a magnetic field for moving a plunger 44 to a desired position. The position of the plunger 44 dictates the position of the flow control member 30 within the passageway 33. The computer 34 monitors the position of the plunger 44 by means of a position sensor 60 that provides a feedback output signal as the magnetically permeable plunger 44 moves in response to solenoid energization. The feedback signal from the sensor 60 is directly related to the plunger position so that the computer 34 can adjust the pulse width modulation duty cycle to achieve a desired plunger position.

The flow control member 30 includes a valve head 114 which moves back and forth with respect to the valve body 32 in the passageway 33 to control flow through the body. The valve head 114 is connected to an elongated valve shaft or stem 116 which extends away from the valve body through a stationary guide 120. In its fully closed position, the valve head rests against a valve seat 124. A tapered throat 126 characterizes the flow vs. position of the valve.

The solenoid winding 42 has a large number of turns wound circumferentially around and along a length of the plunger 44. The plunger 44 is a cold rolled steel annulus supported within a thin wall metal casing or tube 140 closed at one end by a molded sub-assembly 144 that supports the sensor 60. A compressed spring 142 biases the plunger 44 toward the position shown in FIG. 3 which closes the passageway to gas flow.

A metal retainer 150 is crimped onto one end of the shaft 116 and extends into a stepped center passageway 152 in the plunger 44. The retainer 150 has a cylindrical center portion 153 that fits over the end of the shaft. When this center section is deformed by crimping, it is forced into a groove 155 in the shaft. The retainer 150 defines a cup-like seat for the compressed spring 142 that biases the valve head 114 toward a closed position against the seat 124. To open the valve and increase the volume of gas flowing from the inlet to the outlet, the plunger 44 is moved against the biasing action of the spring 142. This movement applies a force to the retainer 150 to move the elongated shaft 116 and attached valve head 114 as the spring 142 compresses. The valve head 114 is pushed away from the position shown in FIG. 3 to allow a controlled volume of fluid to flow between the head 114 and the valve seat 124.

Controlled energization of the winding 42 is performed by regulating an on and off period of a pulse width modulated signal applied to the winding 42 that results in a controlled average coil current. The amount of fluid flow from the valve inlet to the outlet is adjusted by increasing or decreasing the pulse "on" time while maintaining a nominal frequency of 128 hertz. The self-inductance of the coil winding 42 and the mechanical inertia of the plunger 44 assure the coil winding carries an average current related to this pulse "on" time.

The sensor 60 includes two electrically interconnected conductive wiper elements 156 attached to a follower 158 that moves back and forth in the molded sub-assembly 144 as the plunger 44 moves. The follower 158 is biased against the plunger 44 by a compression spring 160 and has a shaft 162 that extends through an opening in the sub-assembly 144 to contact a wire clip 161 that allows air flow in the center passageway 152 and is seated within a well 159 (FIG. 3A) in the plunger 44. The spring 160 fits into an annular groove 166 in a plastic cover 168 that fits within the sub-assembly 144. The sensor 60 is assembled by inserting the follower into a cavity 169 at one end of the sub-assembly 144, placing the cover 168 over the follower and ultrasonically welding the cover 168 and sub-assembly 144 together.

The compressed spring 160 causes the follower 158 to move with the plunger 44 so that the wiper elements 156 moves across two parallel resistive surfaces supported by a substrate 164 mounted within slots 170 in the molded subassembly 144. By monitoring an electric potential of the wiper elements, the controller 34 monitors the position of the plunger 44. Only one of the two side-by-side wiper elements is visible in the section view of FIG. 3.

The valve body 32 supports the valve stem guide 120 and a heat shield 182 having an opening through which the stem 116 extends. The heat shield 182 includes a skirt 184 that borders the flow passageway 33 in the valve body 32. The guide 120 contacts the shield 182 and has an annular ridge 185 co-planar will a surface 186 of the valve body. A gasket 187 having a cutout to accommodate the guide 120 contacts the ridge 185 and inhibits gas in the passageway 33 from exiting the valve body where the guide 120 engages the valve body. A heat shield 190 for the solenoid is secured to the valve body 32 by means of connectors 192 which extend through the shield 190 into threaded openings in a removable valve body plate 191.

After the heat shield 190 is attached to the valve body, a metal spring cup 194 with an opening 195 in its center is placed over the elongated valve shaft 116. A depression 196 in the spring cup 194 forms a seat for one end of the compression spring 142. This spring is placed over the shaft and seated into the depression 196 before the retainer 150 is crimped onto the stem 116 to trap the spring in place.

The coil winding 42 is supported within a plastic bobbin 198. Three magnetic pole pieces 200–202 having high magnetic permeability such as steel border the solenoid coil winding 42. A first outer magnetic piece 200 fits into the heat shield 190 and rests on a lip. 212 that extends circumferentially around the plate 194. A second magnetic pole piece 201 contacts the pole piece 200 and fits between the bobbin 198 and the shield 190. The other pole piece 202 completes a magnetic circuit that surrounds the plunger 44. The three magnetic pieces 200–202, the plunger 44 and the shield 190 define a magnetic circuit for magnetic fields set-up by controller energization of the solenoid coil 42.

Figure 4:
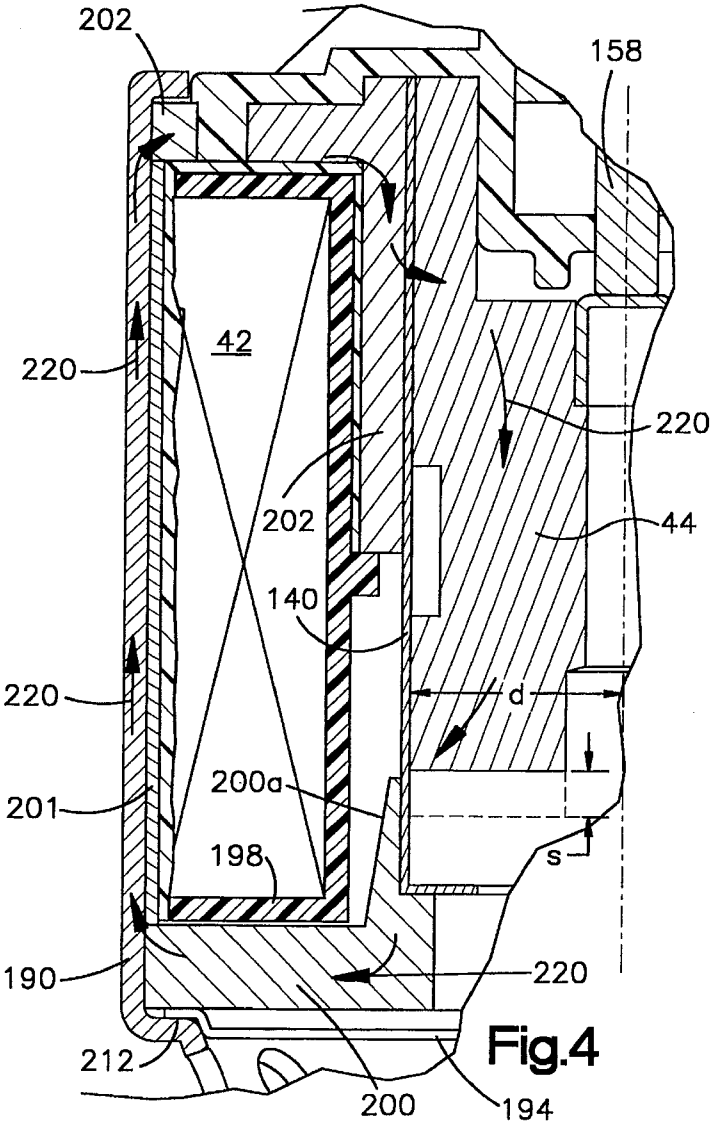
FIG. 4 is an enlarged view of the FIG. 3 section view to show magnetic coupling between a plunger and a magnetic pole piece.
Figure 2:
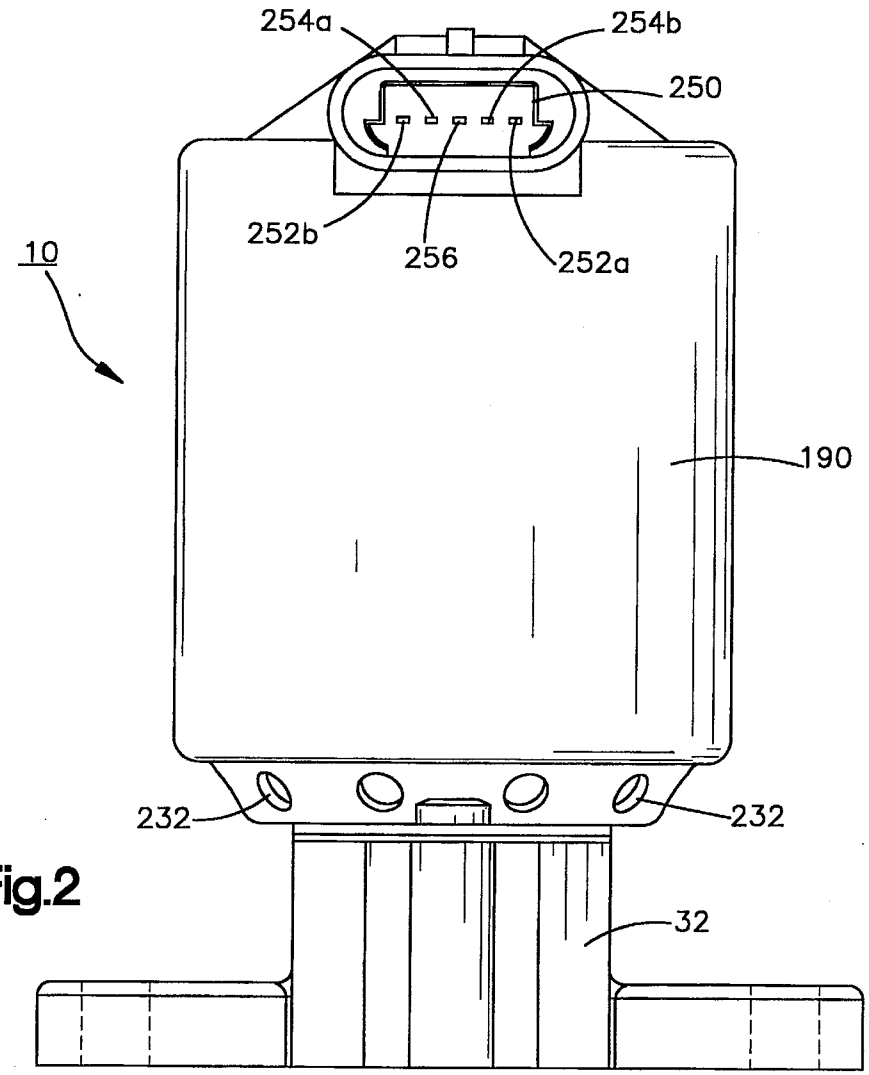
FIG. 2 is a plan view of an exhaust gas recirculating (EGR) valve assembly constructed in accordance with the invention.

As seen in FIG. 4, arrows 220 indicate the path for the magnetic circuit which travels through the pole pieces 200–202 into and out of the plunger 44. The magnetic potential difference across each element of the path is relatively independent of the position of the plunger 44, except for the magnetic potential difference between the plunger 44 and the pole piece 200.

The magnetic field set up by the combination of the pole pieces 200–202, the plunger 44 and the coil 42 is most easily analyzed by consideration of the changes in magnetic energy as the plunger 44 moves. The force exerted on the plunger 44 by the magnetic field is related to the change in magnetic energy of the system as a function of position. The plunger 44 reaches a stable position when this force is balanced by an equal and opposite force of the spring 142 tending to return the valve head 114 to the valve seat 124.

Figure 3:
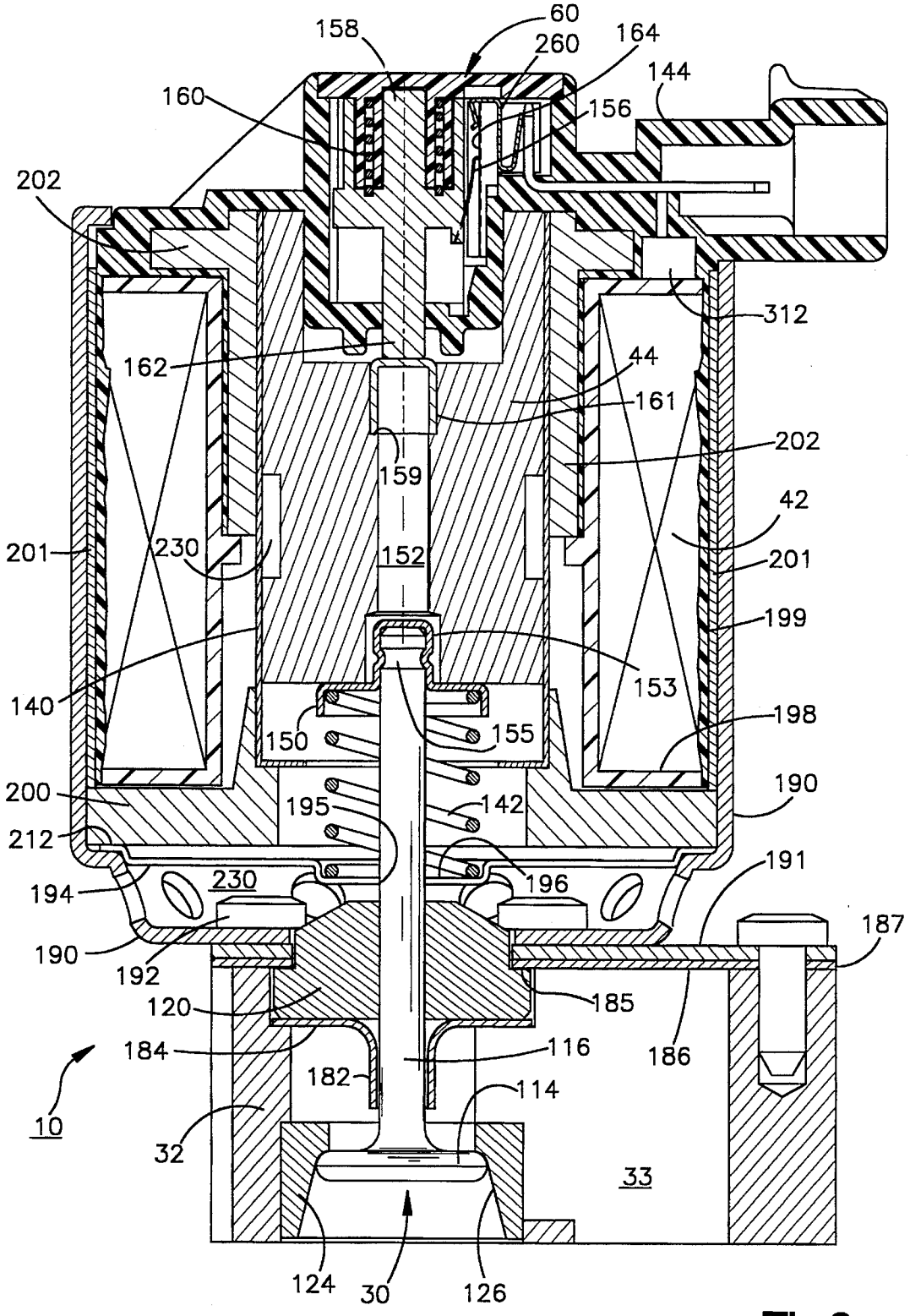
FIG. 3 is a section view of the FIG. 2 valve assembly 2.

When the valve head 114 is seated as shown in FIG. 3, the magnetic circuit extends across a significant air gap since the plunger 44 does not extend into a region surrounded by the pole piece 200. As current through the solenoid coil 42 increases, magnetic forces on the plunger 44 move the plunger against the force of the spring 142. As the plunger 44 moves, a magnetic potential difference across the gap between the plunger 44 and the pole piece 200 changes since the plunger 44 enters the region bounded by the pole piece 200.

A magnetic permeance of the gap between the plunger 44 and pole piece 200 is proportional to a surface area A of the amount of overlap divided by the width r of the gap. In the disclosed design, r is invariant and approximately the thickness of the tube 140. In equation form, this is:

$$\text{Permeance } (P) \propto A/r \quad \text{or} \quad 2\pi\frac{d \cdot s}{r},$$

where s is the amount of plunger overlap with the pole piece 200 and d is the plunger radius (see FIG. 4).

The force generated on the plunger 44 is proportional to the difference in magnetic energy between different plunger positions. For the coil/plunger geometry shown in FIG. 3, this is the magnetic potential drop across the gap between the plunger and the pole piece raised to the power of 2 multiplied by the change of permeance with respect to movement of the plunger 44. In equation form, this is:

$$\text{Force} \propto (\text{mag. potential})^2 \frac{dP}{ds}$$

A gap or groove 230 extends circumferentially around the outer surface of the plunger. The gap 230 intercepts field lines and keeps the magnetic permeance across the gap between the plunger 44 and the pole piece 202 constant with respect to plunger position. This is because the area of magnetic material overlap of the pole piece 202 is constant and hence the derivative of the permeance with respect to stroke is zero in this region, making the force exerted on this end of the plunger 44 due to changes in magnetic coupling zero.

As the other end of the plunger 44 moves with respect to the tapered pole piece 200, however, the magnetic force acting on the plunger 44 changes as a function of the position of the plunger 44. Since the permeance is approximately linearly related to plunger overlap s (avoiding ringing affects), the derivative with respect to overlap is constant. This means the magnetic potential term in the force relation dictates how the force varies with plunger position.

The shape of a taper **200*a* on the pole piece 200 in combination with a changing duty cycle in the coil 42 controls the magnetic potential term in the force relation. The response of the plunger 44 to coil energization is controlled by the shape of this taper to provide a linear relation between force acting on the plunger and plunger position. More particularly, as the spring 142 is compressed, the return force exerted on the plunger 44 varies in a generally linear fashion due to the linear tapered section of the pole piece 200**.

The construction of the valve assembly 10 allows high temperature exhaust gases to be routed through the valve body 32. The heat from the exhaust gas is isolated as much as possible from the coil 42 to maintain the coil 42 below 400° F. This insulation prevents the force versus pulse width modulation profile from being dependent on magnetic permeability changes due to changes in temperature. An airspace 230 prevents heat from the exhaust gas from being conducted directly to the coil 42. The only heat conducted to the coil passes through the shield 190 or the shaft 116. Holes 232 (FIG. 3) in the shield 190 allow air to flow through the airspace 230 and remove much of the heat. The spring cup 194 also acts as a heat shield to stop radiation and convection heat transfer from the hot valve body 32 to the coil 42.

A pressure differential across the seat 124 acts to close the passageway 33, but allows a low current to open the valve. Normally, a reverse acting valve with spring loading can be unstable at closing. The shape of the seat 124 and the large mass of the plunger 44 inhibit unstable operation at valve closure. Also, the center passage 152 in the plunger 44 acts as a damper to keep oscillations from occurring. Because the plunger is not attached to the shaft, binding of the stem due to misalignment of the stem and plunger does not occur.

Electric signals that energize the coil 42 and monitor plunger movement are routed by a cable having female contacts that malt with male contacts of a housing connector 250. Two contacts **252*a*, 252*b*, are coupled to opposite ends of the winding 42 and apply a pulse width modulated signal to the winding as dictated by the computer 34. Two other contacts 254*a*, 254*b*, energize opposite ends of one resistive layer 272. The final contact 256 is electrically coupled to the wipers 156 and provides a feedback signal corresponding to the position of the plunger 44**.

Figures 3A, 5, 6:
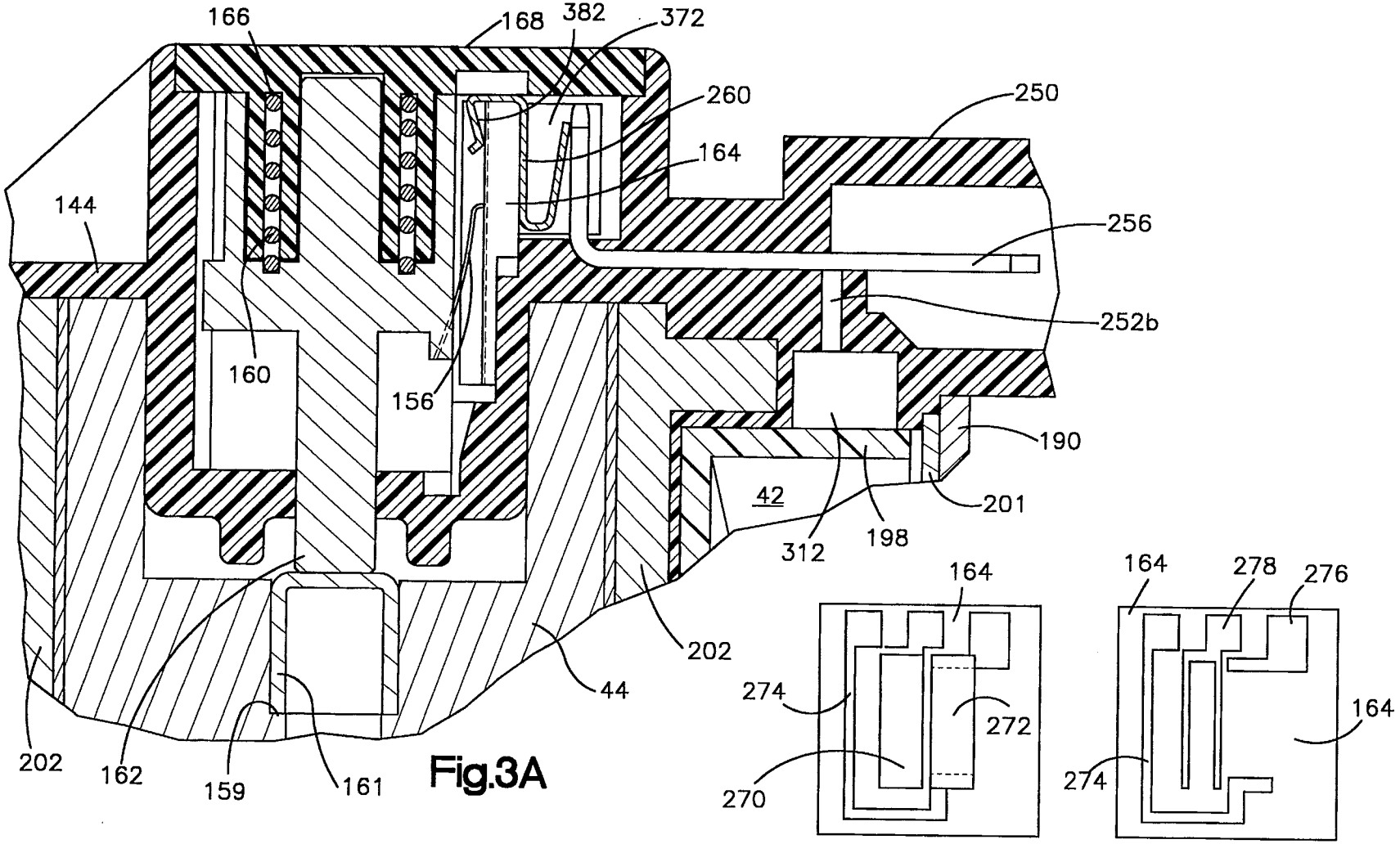
FIG. 3A is an enlarged section view of a movement sensor for monitoring movement of a valve stem.
FIGS. 5 and 6 are plan views of a substrate that forms a part of the movement sensor.
Figure 7:
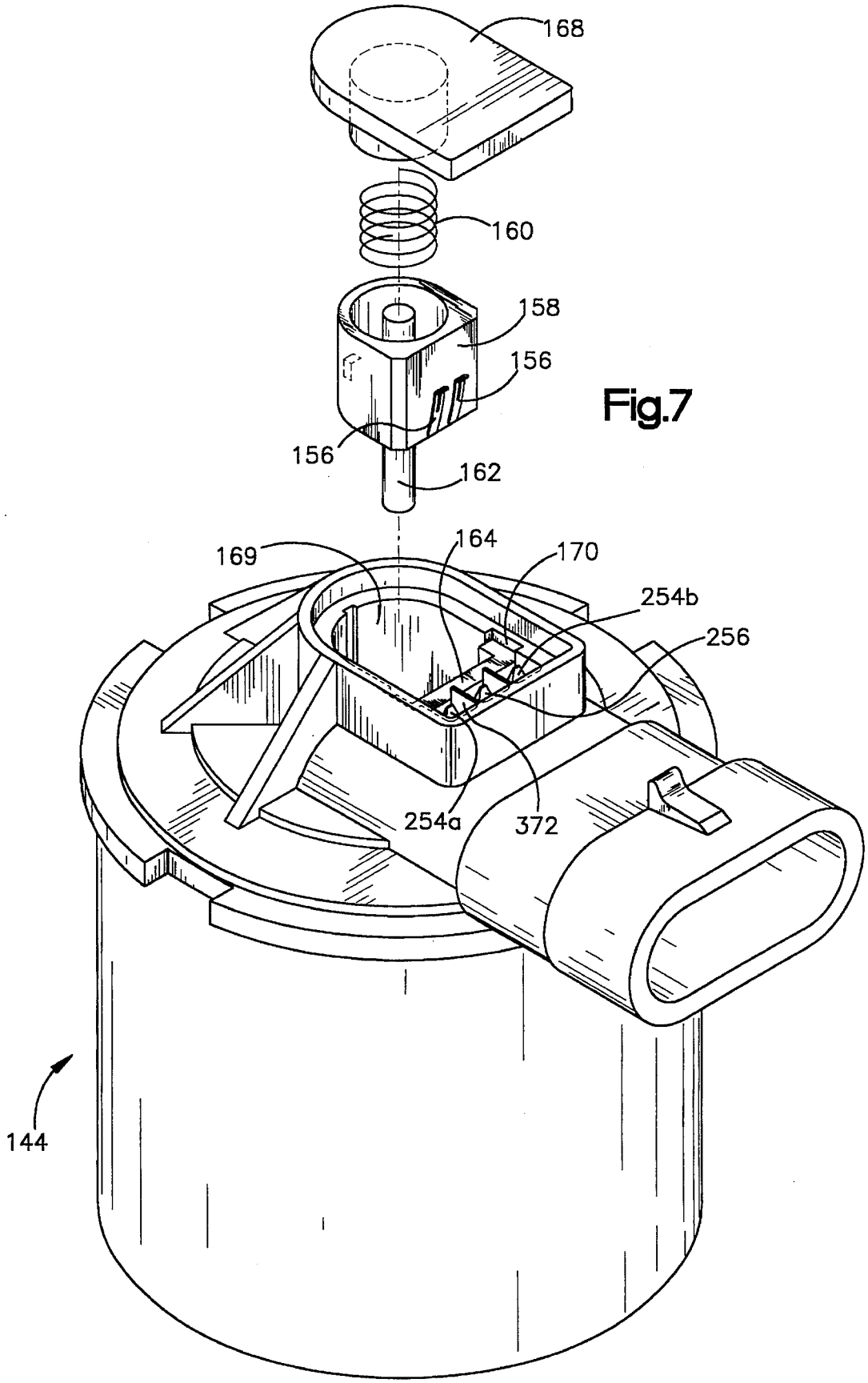
FIG. 7 is an exploded perspective view showing a plastic molded portion of the valve assembly of FIG. 2 prior to assembly of the EGR valve.
Figure 8:
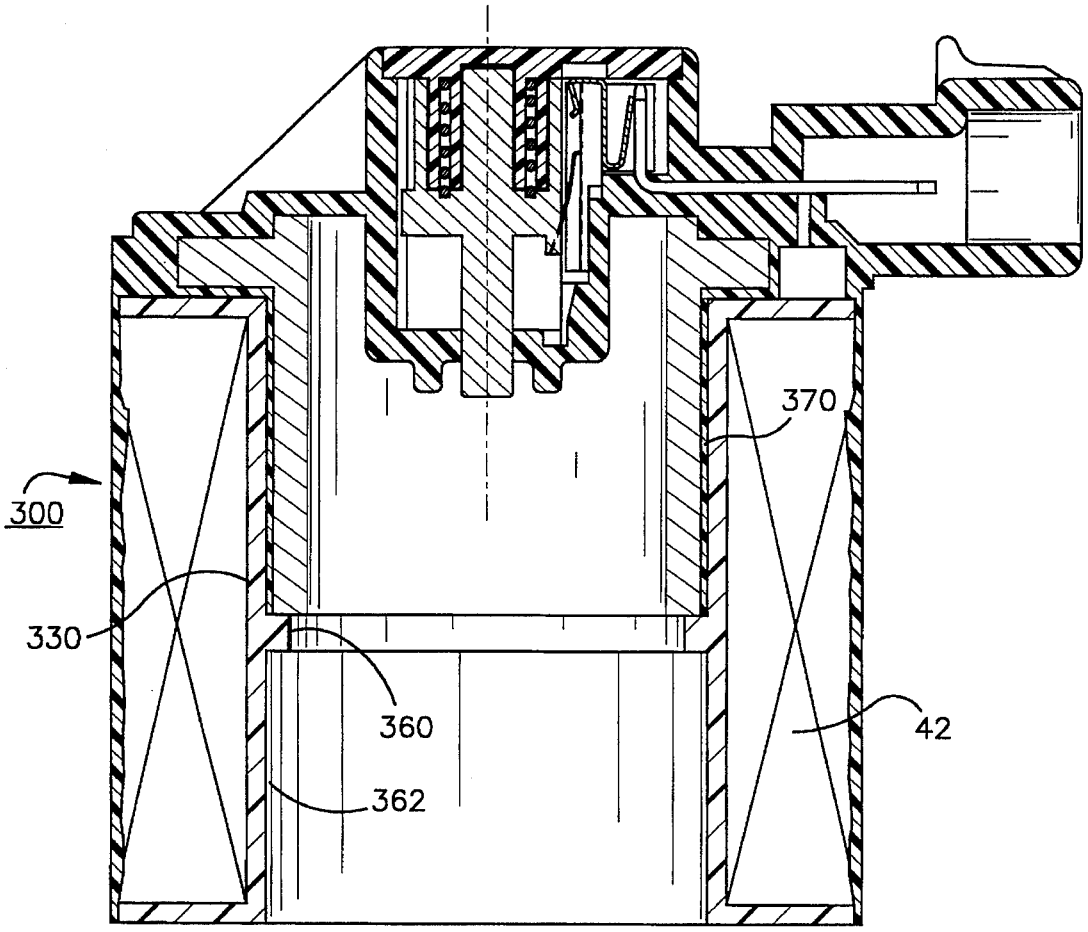
FIG. 8 is a section view of the plastic molded portion of FIG. 7.

As seen most clearly in FIG. 3A, the contacts extend from the region of the connector 250 into an interior of the molded plastic sub-assembly 144. The two contacts **252*a*, 252*b*, are in electrical contact with opposite ends of the coil. The contacts 254*a*, 254*b*, 256 extend to the region the sensor 60 where they are coupled to resistive patterns on the substrate 164 by three clips 260**.

The substrate 164 supports two resistive patterns 270, 272 which are added to the substrate after three conductor patterns 274, 276, 278 are applied to the substrate 164. The two conductor patterns 274, 276 are electrically connected to the contacts **254*a*, 254*b*, and are electrically connected to opposite ends of the resistive layer 272. (See FIG. 5) The conductor 278 has two elongated extensions that extend beneath the resistive layer 270. The conductor 278 is electrically coupled to the contact 256. As the two electrically connected wipers 156 move up and down with the plunger 44, a part of a direct current signal applied across the contacts 254***a*, 254*b*, is tapped off the resistive layer 272 and connected by the layer 270 to the conductor 278 and the output contact 256. This signal is used by the controller 34 to monitor the position of the valve head and confirm that this position changes as the pulse width modulation duty cycle applied to the coil 42 is changed.

Before the sub-assembly 144 is molded, the coil 42 is wound around the bobbin 198 and the contacts 252*a*, 252*b*, are electrically connected to opposite ends of the coil 42. The bobbin 198 and coil 42 are depicted as a coil assembly 300 shown in the perspective view of FIG. 11.

The contacts 252*a*, 252*b*, are shown extending above a top surface 302 the bobbin 198 from two contact mounting posts 310, 312. The contact mounting posts 310, 312 are integrally molded with the plastic bobbin 198 and include slots 310*a*, 312*a*, for routing ends of the wire 314 that forms the coil to the contacts 252*a*, 252*b*.

Before the coil is wound, the two contacts 252*a*, 252*b*, are first attached to the bobbin by inserting them into recesses in the mounting posts 310, 312 that are formed in those posts when the bobbin is molded. The contacts are secured to the mounting posts 310, 312 by a suitable adhesive.

An innermost end of the wire 314 is wrapped multiple times around the contact 252*b* and routed through the slot 310*a* to a groove 320 formed in a circular lip 322 molded in the bobbin 198. The wire 314 is wound half way around the bobbin 198 between the lip 322 and the bobbin's top surface 300.

On the side of the bobbin 198 opposite the two contacts 252*a*, 252*b*, the wire is pushed through a slot 324 in the bobbin and wound around a cylindrical bobbin support surface 330. Multiple turns of wire first cover the bobbin surface 330 and further turns contact previous wire layers. Winding of the coil 42 continues until the wire nearly fills the bobbin.

An outer end of the wire exits the bobbin 198 through a second gap 332 in the bobbin between the mounting posts 310, 312. This end is pushed through the slot 312*a* and wound around the contact 252*b* to assure good electrical engagement between the coil 42 and the contact 252*b*.

Figure 9:
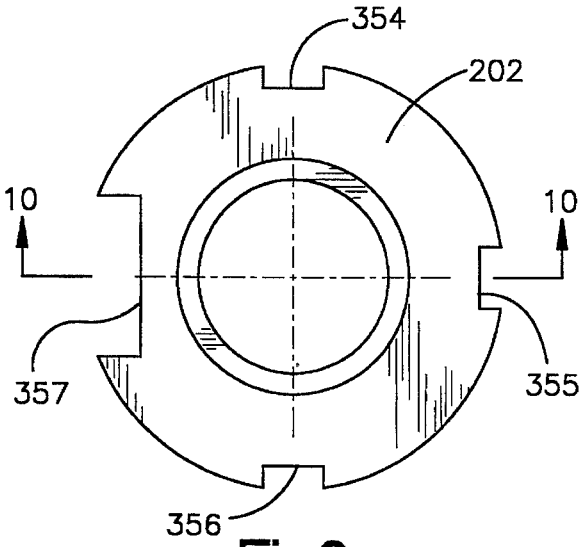
FIGS. 9 and 10 are plan and section views of one of three pole pieces of the EGR valve.
Figure 10:
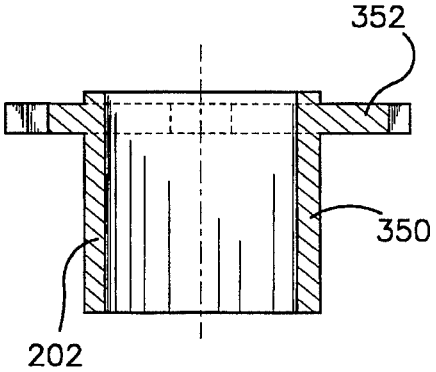

The completed bobbin assembly 300 is then molded with the pole piece 202 to form the molded sub-assembly 144. The pole piece 202 is depicted in greater detail in FIGS. 9 and 10. This magnetically permeable pole piece 202 has a generally cylindrical body 350 that extends roughly one half the length of the thin wall casing 140 in the assembled EGR valve. Extending radially outward from the cylindrical body 350 is a flange 352 that has four notches 354–357 formed as the pole piece is cast.

Figure 11:
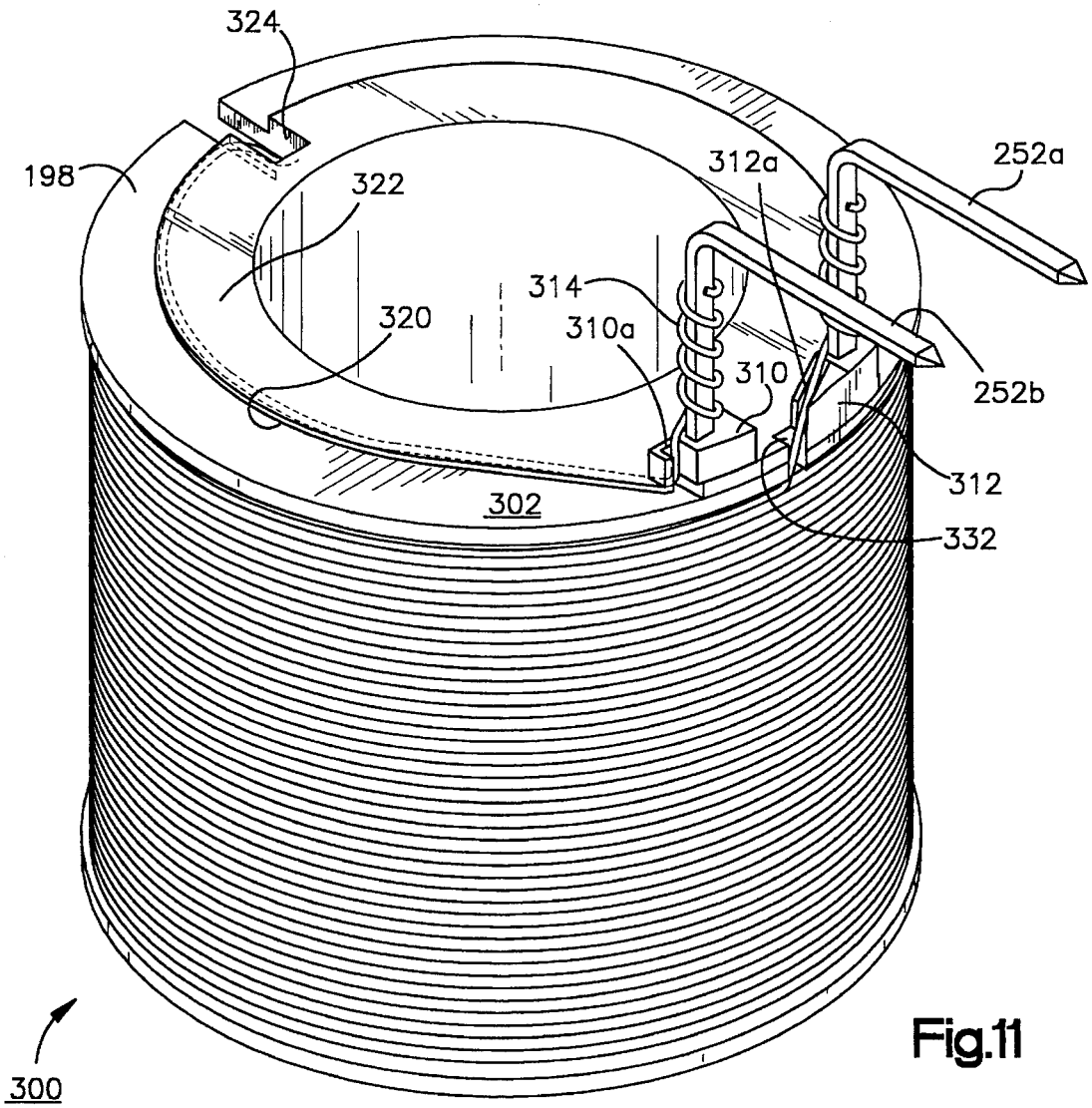
FIG. 11 is a perspective view of a bobbin that supports a solenoid coil wrapped around the bobbin before the bobbin is put into a mold used to form the plastic molded housing portion of FIG. 7.

The bobbin assembly 300 is placed in a mold (not shown) and the pole piece 202 is inserted into the bobbin assembly so that a base of the cylindrical body 350 rests against a ridge 360 in an inwardly facing wall 362 of the bobbin 198. When centered within the bobbin an outwardly facing wall 364 of the pole piece is spaced from the inwardly facing wall 364 of the bobbin by a gap 370. The other electrical contacts 254*a*, 254*b*, 256 are positioned between the two contacts attached to the bobbin 198 and the sub-assembly 144 is formed in a mold. Note, that during molding of the the plastic flows through the gap 370 between the bobbin and the pole piece 202 and also flows through the notches 354–357 in the pole piece so that plastic covers an outer layer of wire of the coil 42 that is exposed in the FIG. 11 depiction.

Figure 12:
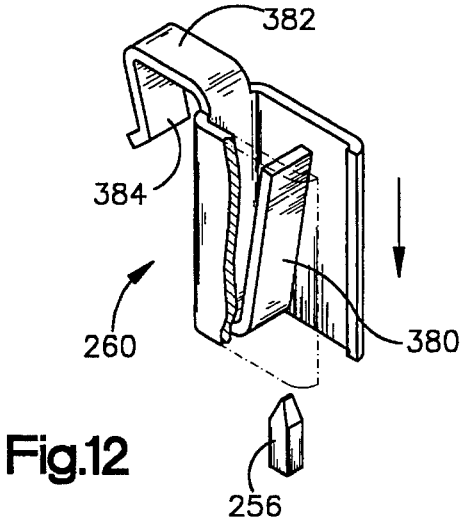
FIG. 12 is a perspective view of a metal clip used to complete a circuit for monitoring a postion of the valve stem.

The cover 168 and follower 158 are separately molded pieces. When the sub-assembly is removed from its mold, ends of the contacts 254*a*, 254*b*, 256 are exposed within side pockets 372 that extend away from the cavity 169 at one end of the sub-assembly 144. To complete assembly of the postion sensor 60, the substrate 164 is placed into the cavity 169 by inserting it into the slots 170 on opposite sides of the cavity 169. Once the substrate is in place the clips 260 (FIG. 12) are placed over ends of the three contacts 254*a*, 254*b*, 256. Each of the clips 260 has a deformable metal member 380 that engages an associated contact and a curved hanger 382 that fits over the substrate 164. The hanger has a contact surface 384 that engages contact pads at the top of the substrate 164 which form part of the conductors 274, 276, 278.

Figure 13:
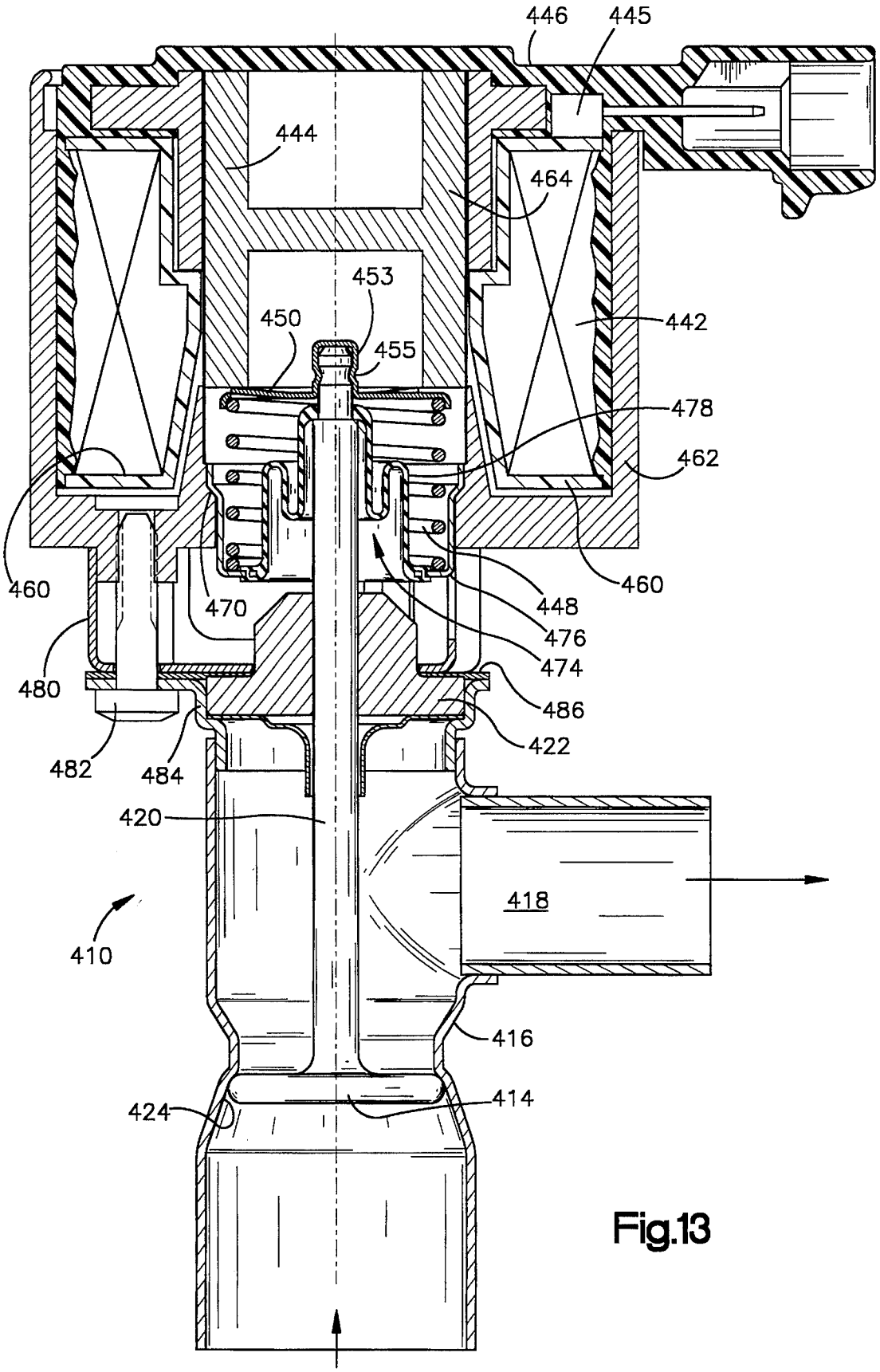
FIG. 13 is a section view of an alternate embodiment of an EGR valve assembly.

FIG. 13 depicts an alternate embodiment of a valve assembly 410 constructed in accordance with the invention. In this embodiment the controller 34 monitors fluid flow with a flow sensor (not shown) so there is no position sensor to monitor the position of a flow control member. The valve assembly 410 includes a valve head 414 which moves back and forth with respect to a valve body 416 in a passageway 418 to control fluid flow through the body 416. The valve head 414 is connected to an elongated valve shaft or stem 420 which extends away from the valve body through a stationary valve stem guide 422. In its fully closed position, the valve head rests against a valve seat 424 formed in the valve body.

A solenoid winding 442 has a large number of turns wound circumferentially around and along a length of a metal plunger 444. The plunger 444 is a cold rolled steel annulus supported within a molded sub-assembly 446. Since the embodiment of FIG. 13 does not include a sensor the molded sub-assembly 446 has no contacts extending inwardly beyond two contacts 445 (only one of which is shown in FIG. 13) that route energizing signals to the coil 442. A compressed spring 448 biases the plunger 444 toward the position shown in FIG. 13 which closes the passageway to gas flow.

A metal retainer 450 is crimped onto one end of the shaft 420 and extends into a cavity within the plunger 444. The retainer 450 has a cylindrical center portion 453 that fits over the end of the shaft. When this center section is deformed by crimping, it is forced into a groove 455 in the shaft. The retainer 450 defines a cup-like seat for the compressed spring 448 that biases the valve head 414 toward a closed position against the seat 424. To open the valve and increase the volume of gas flowing from the inlet to the outlet, the plunger 444 is moved against the biasing action of the spring 448. This movement applies a force to the retainer 450 to move the elongated shaft and attached valve head 414 as the spring 448 compresses. The valve head 414 is pushed away from the position shown in FIG. 13 to allow a controlled volume of fluid to flow through a gap between the valve head 414 and the valve seat 424.

The coil winding 442 is supported within a plastic bobbin 460. Two magnetic pole pieces 462, 464 having high magnetic permeability such as steel border the solenoid coil winding 442. The two magnetic pieces 462, 464 and the plunger 444 define a magnetic circuit for magnetic fields set-up by controller energization of the solenoid coil 442. Rather than monitor a position of the plunger 444, a controller 34 monitors actual fluid flow through the passage way 418. The same pulse width modulation control scheme is used to energize the coil 442 but a separate flow sensor confirms response to the coil energization.

The magnetic pole piece 462 forms a cavity into which the molded plastic sub-assembly 446 is placed during valve assembly. The pole piece 462 defines a radially inwardly extending lip 470 at one end of the coil 442. This lip supports a metal seat assembly 474 for the spring 448. The assembly 474 has a spring seat 476 that seats in the lip 470 and supports the spring. A seal 478 fits inside the spring 448 and engages a reduced diameter end of the stem 420 near the retainer 450.

The valve stem guide 422 is spaced from the pole piece 448 by a shell 480 having openings around its circumference to allow air flow between the valve body and the coil assembly. Connectors 482 exent through a flange 484 connected to the valve body into threaded openings in the pole piece 462 to attach the valve body to the coil assembly. A gasket 486 between the shell and the flange impedes high temperature gases from flowing through the valve body from reaching the plastic molded sub-assembly 446.

The present invention has been described with a degree of particularity, but it is the intent that the invention include all variations from the disclosed design falling within the spirit or scope of the appended claims.

We claim:

1. A valve actuator assembly comprising:

(a) a bobbin defining a coil region;

(b) a conductive coil disposed in the coil region for generating a magnetic field to actuate axial movement of a plunger through a plunger region defined in relation to the bobbin; and (c) a molding formed around the bobbin such that the molding in combination with the bobbin encapsulate the conductive coil in the coil region, the molding extending over at least a portion of one end of the plunger region and defining a cavity at the one end of the plunger region for supporting a position sensor for sensing a relative position of the plunger in the plunger region.

2. The valve actuator assembly of claim 1, comprising electrical contacts partially encapsulated by the molding and coupled to the conductive coil for energizing the conductive coil.

3. The valve actuator assembly of claim 1, comprising a magnetic pole piece fixed in relation to the bobbin by the molding and coaxially aligned with the plunger region along an axial extent of the plunger region.

4. The valve actuator assembly of claim 1, in combination with the position sensor, the position sensor including:

(i) a follower inserted in the cavity defined by the molding and having a conductive wiper, the follower extending into the plunger region and supported in the cavity for axial movement by the plunger, and (ii) a resistive substrate configured for electrical contact with the conductive wiper, the resistive substrate for generating a feedback signal indicating the relative position of the plunger based on a position of the conductive wiper relative to the resistive substrate.

5. The valve actuator assembly of claim 4, comprising electrical contacts partially encapsulated by the molding and coupled to the position sensor for energizing the position sensor and for carrying the feedback signal.

6. The valve actuator assembly of claim 1, in combination with:

(d) the plunger; and (e) an actuator housing defining a receptacle for receiving the valve actuator assembly in combination with the plunger.

7. The valve actuator assembly of claim 6, in combination with:

(f) a plunger casing inserted in the plunger region, the plunger casing defining a receptacle for guiding the axial movement of the plunger.

8. The valve actuator assembly of claim 6, in combination with:

(f) a valve body coupled to the actuator housing, the valve body having an inlet and an outlet and defining a throughpassage between the inlet and the outlet; and (g) a flow control member coupled to the plunger and configured in the valve body to control flow through the throughpassage.

9. The valve actuator assembly of claim 8, in combination with an internal combustion engine coupled to the valve body.

10. A valve actuator assembly comprising:

(a) a bobbin defining a coil region;

(b) a conductive coil disposed in the coil region for generating a magnetic field to actuate axial movement of a plunger through a plunger region defined in relation to the bobbin;

(c) a magnetic pole piece inserted in the plunger region and having an inner region coaxially aligned with the plunger region along an axial extent of the plunger region; and (d) a molding formed around the bobbin such that the molding in combination with the bobbin encapsulate the conductive coil in the coil region, the molding fixing the magnetic pole piece in relation to the bobbin and extending over at least a portion of one end of the inner region of the magnetic pole piece.

11. The valve actuator assembly of claim 10, comprising electrical contacts partially encapsulated by the molding and coupled to the conductive coil for energizing the conductive coil.

12. The valve actuator assembly of claim 10, in combination with a position sensor configured at one end of the plunger region for sensing a relative position of the plunger in the plunger region.

13. The valve actuator assembly of claim 10, in combination with:

(e) the plunger; and (f) an actuator housing defining a receptacle for receiving the valve actuator assembly in combination with the plunger.

14. The valve actuator assembly of claim 13, in combination with:

(g) a plunger casing inserted in the plunger region, the plunger casing defining a receptacle for guiding the axial movement of the plunger.

15. The valve actuator assembly of claim 13, in combination with:

(g) a valve body coupled to the actuator housing, the valve body having an inlet and an outlet and defining a throughpassage between the inlet and the outlet; and (h) a flow control member coupled to the plunger and configured in the valve body to control flow through the throughpassage.

16. The valve actuator assembly of claim 15, in combination with an internal combustion engine coupled to the valve body.

17. A method for fabricating a valve actuator assembly comprising the steps of:

(a) winding a conductive coil in a coil region of a bobbin, the conductive coil for generating a magnetic field to actuate axial movement of a plunger through a plunger region defined in relation to the bobbin;

(b) forming a molding around the bobbin such that the molding in combination with the bobbin encapsulate the conductive coil in the coil region and such that the molding extends over at least a portion of one end of the plunger region and defines a cavity at the one end of the plunger region; and (c) inserting a position sensor in the cavity defined by the molding, the position sensor supported in the cavity for sensing a relative position of the plunger in the plunger region.

18. The method of claim 17, wherein the forming step (b) includes the step of partially encapsulating in the molding electrical contacts coupled to the conductive coil for energizing the conductive coil.

19. The method of claim 17, comprising the step of inserting in the plunger region a magnetic pole piece coaxially aligned with the plunger region along an axial extent of the plunger region; and wherein the forming step (b) includes the step of forming the molding so as to fix the magnetic pole piece in relation to the bobbin.

20. The method of claim 17, wherein the inserting step (c) includes the steps of:

(i) inserting a follower in the cavity defined by the molding such that the follower extends into the plunger region and is supported in the cavity for axial movement by the plunger, and (ii) configuring a resistive substrate for electrical contact with a conductive wiper coupled to the follower, the resistive substrate for generating a feedback signal indicating the relative position of the plunger based on a position of the conductive wiper relative to the resistive substrate.

21. The method of claim 10, wherein the forming step (b) includes the step of partially encapsulating in the molding electrical contacts for energizing the position sensor and for carrying the feedback signal.

22. The method of claim 17, comprising the steps of:

(d) inserting the plunger in the plunger region; and (e) placing the valve actuator assembly in a receptacle defined by an actuator housing.

23. The method of claim 22, comprising the step of:

(f) inserting a plunger casing in the plunger region, the plunger casing defining a receptacle for guiding the axial movement of the plunger.

24. The method of claim 22, comprising the steps of:

(f) coupling to the actuator housing a valve body having an inlet and an outlet and defining a throughpassage between the inlet and the outlet; and (g) coupling a flow control member to the plunger and configuring the flow control member in the valve body to control flow through the throughpassage.

25. The method of claim 24, comprising the step of coupling the valve body to an internal combustion engine.

26. A method for fabricating a valve actuator assembly comprising the steps of:

(a) winding a conductive coil in a coil region of a bobbin, the conductive coil for generating a magnetic field to actuate axial movement of a plunger through a plunger region defined in relation to the bobbin;

(b) inserting in the plunger region a magnetic pole piece having an inner region coaxially aligned with the plunger region along an axial extent of the plunger region; and (c) forming a molding around the bobbin such that the molding in combination with the bobbin encapsulate the conductive coil in the coil region, such that the molding fixes the magnetic pole piece in relation to the bobbin, and such that the molding extends over at least a portion of one end of the inner region of the magnetic pole piece.

27. The method of claim 26, wherein the forming step (c) includes the step of partially encapsulating in the molding electrical contacts coupled to the conductive coil for energizing the conductive coil.

28. The method of claim 26, comprising the step of configuring a position sensor at one end of the plunger region for sensing a relative position of the plunger in the plunger region.

29. The method of claim 26, comprising the steps of:

(d) inserting the plunger in the plunger region; and (e) placing the valve actuator assembly in a receptacle defined by an actuator housing.

30. The method of claim 29, comprising the step of:

(f) inserting a plunger casing in the plunger region, the plunger casing defining a receptacle for guiding the axial movement of the plunger.

31. The method of claim 29, comprising the steps of:

(f) coupling to the actuator housing a valve body having an inlet and an outlet and defining a throughpassage between the inlet and the outlet; and (g) coupling a flow control member to the plunger and configuring the flow control member in the valve body to control flow through the throughpassage.

32. The method of claim 31, comprising the step of coupling the valve body to an internal combustion engine.

* * * * *